US010907653B2

(12) United States Patent
Sakaguchi

(10) Patent No.: US 10,907,653 B2
(45) Date of Patent: Feb. 2, 2021

(54) VACUUM PUMP

(71) Applicant: Edwards Japan Limited, Chiba (JP)

(72) Inventor: Yoshiyuki Sakaguchi, Chiba (JP)

(73) Assignee: Edwards Japan Limited, Chiba (JP)

( * ) Notice: Subject to any disclaimer, the term of this patent is extended or adjusted under 35 U.S.C. 154(b) by 141 days.

(21) Appl. No.: 15/774,861

(22) PCT Filed: Oct. 31, 2016

(86) PCT No.: PCT/JP2016/082213
§ 371 (c)(1),
(2) Date: May 9, 2018

(87) PCT Pub. No.: WO2017/086135
PCT Pub. Date: May 26, 2017

(65) Prior Publication Data

US 2018/0335052 A1 Nov. 22, 2018

(30) Foreign Application Priority Data

Nov. 16, 2015 (JP) ..... 2015-224199

(51) Int. Cl.
*F04D 29/58* (2006.01)
*F04D 19/04* (2006.01)
*F04D 27/00* (2006.01)

(52) U.S. Cl.
CPC ..... *F04D 29/5853* (2013.01); *F04D 19/042* (2013.01); *F04D 19/044* (2013.01);
(Continued)

(58) Field of Classification Search
CPC .. F04D 29/5853; F04D 19/044; F04D 29/584; F04D 19/046; F04D 19/042; F04D 27/006; F04D 19/04; F04D 29/588
See application file for complete search history.

(56) References Cited

U.S. PATENT DOCUMENTS 5,618,167 A * 4/1997 Hirakawa ..... F04D 19/04 417/372
2002/0039533 A1* 4/2002 Miyamoto ..... F04D 19/04 417/313

(Continued)

FOREIGN PATENT DOCUMENTS

JP H0191096 6/1989
JP H0612794 2/1994

(Continued)

OTHER PUBLICATIONS

Communication dated May 27, 2019 and Supplemental European Search Report dated May 17, 2019 for corresponding European Application No. EP16866137.9.

(Continued)

*Primary Examiner* — Aaron R Eastman
(74) *Attorney, Agent, or Firm* — Theodore M. Magee; Westman, Champlin & Koehler, P.A.

(57) ABSTRACT

Provided is a vacuum pump that prevents the solidification of gas while being operated properly. The vacuum pump includes a rotor that is supported rotatably on a base, a stator that has a thread groove portion, and a heating structure that heats the stator. The heating structure has a spacer that insulates the stator from stator components other than the stator, and a cartridge heater that heats the stator. The distance between a rotor cylindrical portion and the stator at the inlet port side is set to be equal to or greater than the distance between the rotor cylindrical portion and the stator at the outlet port side.

8 Claims, 4 Drawing Sheets

(52) U.S. Cl.
CPC ..... *F04D 19/046* (2013.01); *F04D 27/006* (2013.01); *F04D 29/584* (2013.01)

(56) References Cited

U.S. PATENT DOCUMENTS

| | | | | |
|---|---|---|---|---|
| 2015/0275914 | A1* | 10/2015 | Tsutsui | F04D 29/584<br>415/177 |
| 2015/0345494 | A1* | 12/2015 | Tsubokawa | F04D 29/522<br>418/220 |
| 2016/0348695 | A1* | 12/2016 | Sakaguchi | F04D 19/042 |

FOREIGN PATENT DOCUMENTS

| | | | | |
|---|---|---|---|---|
| JP | 2002021775 | A | | 1/2002 |
| JP | 2013104430 | A | | 5/2013 |
| JP | 2015 151932 | A | * | 8/2015 |
| JP | 2015229949 | A | | 12/2015 |
| WO | 2012172851 | A1 | | 12/2012 |
| WO | 2015015902 | A1 | | 2/2015 |
| WO | 2015122215 | A1 | | 8/2015 |

OTHER PUBLICATIONS

PCT International Search Report and Written Opinion dated Jan. 31, 2017 for corresponding PCT Application No. PCT/JP2016/082213.

* cited by examiner

VACUUM PUMP

CROSS-REFERENCE OF RELATED APPLICATION

This application is a Section 371 National Stage Application of International Application No. PCT/JP2016/082213, filed Oct. 31, 2016, which is incorporated by reference in its entirety and published as WO 2017/086135 A1 on May 26, 2017 and which claims priority of Japanese Application No. 2015-224199, filed Nov. 16, 2015.

BACKGROUND

The present invention relates to a vacuum pump, and particularly to a vacuum pump that can be used in a pressure range between low vacuum pressure and ultra-high vacuum pressure.

In manufacturing semiconductor devices such as memories and integrated circuits, a high-purity semiconductor substrate (wafer) needs to be subjected to doping and etching in a high-vacuum chamber for the purpose of avoiding the impacts of dust and the like in the air, and a vacuum pump such as a combination pump with a combination of a turbomolecular pump and a thread groove pump is used for evacuation of the chamber.

As this type of a vacuum pump, for example, there has been known a vacuum pump that has a cylindrical casing, a cylindrical stator fixed to the inside of the casing by means of an insert and having a thread groove portion provided therein, and a rotor supported in the stator so as to be rotatable at high speeds. In this vacuum pump the gas is transferred while being compressed in a thread groove pump formed of the rotor and the stator.

However, in the event that the temperature of the stator falls below the sublimation point of the gas, the gas compressed to high pressure, which is transferred through the thread groove pump, solidifies, and the resultant deposited product narrows a gas flow channel, deteriorating the compression performance and exhaust performance of the vacuum pump.

Therefore, as a vacuum pump that prevents the generation of such product, there has been known a vacuum pump that has an insulating space provided around a stator, an insulating spacer supporting the stator, and a heater embedded in the stator (see WO 2015/015902, for example). In this type of a vacuum pump, the heater heats the stator, allowing the gas in the gas flow channel to be transferred without solidifying.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

However, in the foregoing vacuum pump, the higher the temperature of the stator, the easier it is to compress the gas in the gas flow channel while it is in the form of gas, but the risk that the heat escapes from the insulating spacer to the surrounding of the stator is high. There have been risks that the electrical components provided in the vacuum pump and a motor rotating the rotor cannot exert desired functions if the temperature is high, and that the strengths of rotor blades and stator blades drop as the temperature rises, resulting in damage of the rotor blades and stator blades during the operation of the vacuum pump. There has also been a risk that heating the stator to a high temperature ends up letting more heat escape from the stator, harming the operation of the vacuum pump.

These circumstances raise technical problems that need to be solved in order to prevent the solidification of the gas while operating the pump properly, and therefore an object of the present invention is to solve these problems.

The present invention has been contrived in order to achieve the foregoing object. The invention described in claim 1 is a vacuum pump having: a base; a rotor that has a rotor cylindrical portion stored in the base and is supported rotatably on the base; a stator that has a substantially cylindrical shape and is disposed between the base and the rotor cylindrical portion; and a thread groove portion that is engraved on either an outer circumferential surface of the rotor cylindrical portion or an inner circumferential surface of the stator, the vacuum pump including: a heat insulating means for insulating the stator from stator components other than the stator; and a heating means for heating the stator, wherein a distance between the rotor cylindrical portion and the stator at an inlet port side is set to be equal to or greater than a distance between the rotor cylindrical portion and the stator at an outlet port side.

According to this configuration, because the stator is heated while being insulated from the other stator components, malfunctions of electrical components or of the motor caused by heat escaping from the stator and deterioration of the strengths of the rotor blades and stator blades can be prevented. As a result, proper operation of the pump while preventing the solidification of the gas can be realized.

The distance between the rotor and the stator at the inlet port side is set to be equal to or greater than the distance between the rotor and the stator at the outlet port side. Therefore, even in the event that the rotor becomes deformed due to centrifugal force during the operation of the vacuum pump or that the rotor thermally expands due to radiant heat from the stator, the distance between the rotor and the stator can be kept substantially constant from the inlet side all the way to the outlet side, preventing excessive narrowing of a gas flow channel.

The invention described in claim 2 provides a vacuum pump, which, in addition to the configuration of the vacuum pump described in claim 1, has a configuration in which the heat insulating means has a flange portion that comes into contact with the stator in a rotor axial direction and is provided in the base, and a spacer cylindrical portion that comes into contact with the base in a rotor axial direction and is provided in an inner circumferential rim of the flange portion, and the heat insulating means is a spacer for storing the heating means in the flange portion.

According to this configuration, the spacer is interposed between the stator and the base and supports the stator in a rotor axial direction, insulating the stator from the other stator components. Therefore, proper operation of the pump while preventing the solidification of the gas can be realized.

The invention described in claim 3 provides a vacuum pump, which, in addition to the configuration of the vacuum pump described in claim 2, has a configuration in which the spacer inhibits the stator from deforming at least partially in a rotor radial direction when thermally expanded.

According to this configuration, in the event that the rotor cylindrical portion comes into contact with the stator due to an abnormality in the vacuum pump, the spacer can prevent the stator from deforming under the kinetic energy of the rotor, resulting in reducing transmission of the kinetic energy to the outside of the pump.

The invention described in claim 4 provides a vacuum pump, which, in addition to the configuration of the vacuum pump described in claim 2 or 3, has a configuration in which the spacer is a member having a linear expansion coefficient lower than that of the stator.

According to this configuration, the amount of deformation caused by thermal expansion of the spacer is smaller than the amount of deformation caused by thermal expansion of the stator. Therefore, the spacer disposed on the outer circumferential side of the stator in a rotor radial direction can restrict deformation of the stator.

The invention described in claim 5 provides a vacuum pump, which, in addition to the configuration of the vacuum pump described in any one of claims 2 to 4, has a configuration in which a distance from the heating means to a contact portion between the stator and the flange portion is shorter than a distance from the heating means to a contact portion between the base and the spacer cylindrical portion.

According to this configuration, making the heat transfer path from the heating means to the base longer than the heat transfer path from the heating means to the stator can prevent the heat from escaping from the spacer to the base. As a result, proper operation of the pump while preventing the solidification of the gas can be realized.

The invention described in claim 6 provides a vacuum pump, which, in addition to the configuration of the vacuum pump described in any one of claims 2 to 5, has a configuration in which the spacer cylindrical portion allows positioning in a rotor axial direction and is formed thin so as to be capable of elastically deforming in a rotor radial direction.

According to this configuration, even in a case where the stator becomes thermally expanded, the spacer cylindrical portion can elastically become deformed in response to such deformation of the stator, preventing a significant decrease in contact thermal resistance between the stator and the spacer, which is attributed to the stator and the spacer coming into contact with each other excessively. In addition, such a configuration can prevent the heat of the spacer from escaping to the base, realizing proper operation of the pump while preventing the solidification of the gas.

The invention described in claim 7 provides a vacuum pump, which, in addition to the configuration of the vacuum pump described in any one of claims 2 to 6, has a configuration in which the spacer is attached to the stator in a rotor radial direction with a spigot structure.

According to this configuration, even in a case where the stator becomes thermally expanded, a gap ensured between the stator and the spacer in a rotor radial direction can prevent a significant increase in area of contact between the base and the spacer, which is attributed to the stator pressing the spacer in a rotor radial direction and bringing the base and the spacer in contact with each other excessively, as well as a significant decrease in contact thermal resistance between the base and the spacer, which is attributed to such increase in area of contact. Therefore, the escape of the heat of the spacer to the base can be prevented. As a result, proper operation of the pump while preventing the solidification of the gas can be realized.

The invention described in claim 8 provides a vacuum pump, which, in addition to the configuration of the vacuum pump described in any one of claims 2 to 7, has a configuration in which the spacer is attached to the base in a rotor radial direction with a spigot structure.

According to this configuration, even in a case where the spacer becomes thermally expanded, a gap ensured between the base and the spacer in a rotor radial direction can prevent a significant decrease in contact thermal resistance between the base and the spacer, which is attributed to the base and the spacer coming into contact with each other excessively. Therefore, the heat of the spacer can be prevented from escaping to the base. As a result, proper operation of the pump while preventing the solidification of the gas can be realized.

In the vacuum pump according to the present invention, the heat is prevented from escaping from the stator. Therefore, proper operation of the pump while preventing the solidification of the gas can be realized.

Moreover, the distance between the rotor and the stator at the inlet port side is set to be equal to or greater than the distance between the rotor and the stator at the outlet port side. Therefore, even in the event that the rotor becomes deformed due to centrifugal force during the operation of the vacuum pump or that the rotor thermally expands due to radiant heat from the stator, the distance between the rotor and the stator can be kept at a predetermined distance or a substantially constant degree of variation from the inlet side all the way to the outlet side, preventing problems such as excessive narrowing of the gas flow channel.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIGS. 4A and 4B are schematic diagrams for explaining the actions of a spacer, wherein FIG. 4A is a diagram showing a state obtained prior to thermal expansion of the stator and FIG. 4B is a diagram showing a state obtained after thermal expansion of the stator.

DESCRIPTION OF THE PREFERRED EMBODIMENT

In order to achieve the object of preventing solidification of gas while properly operating the pump, the present invention was realized by a vacuum pump having: a base; a rotor that has a rotor cylindrical portion stored in the base and is supported rotatably on the base; a stator that has a substantially cylindrical shape and is disposed between the base and the rotor cylindrical portion; and a thread groove portion that is engraved on either an outer circumferential surface of the rotor cylindrical portion or an inner circumferential surface of the stator, the vacuum pump including: a heat insulating means for insulating the stator from stator components other than the stator; and a heating means for heating the stator, wherein a distance between the rotor cylindrical portion and the stator at an inlet port side is set to be equal to or greater than a distance between the rotor cylindrical portion and the stator at an outlet port side.

Embodiment

A vacuum pump 1 according to an embodiment of the present invention is described hereinafter with reference to the drawings. In the following description, regarding such terms as "upper" and "lower", the inlet port side and the outlet port side in a rotor axial direction correspond to the upper side and the lower side respectively.

Figure 1:
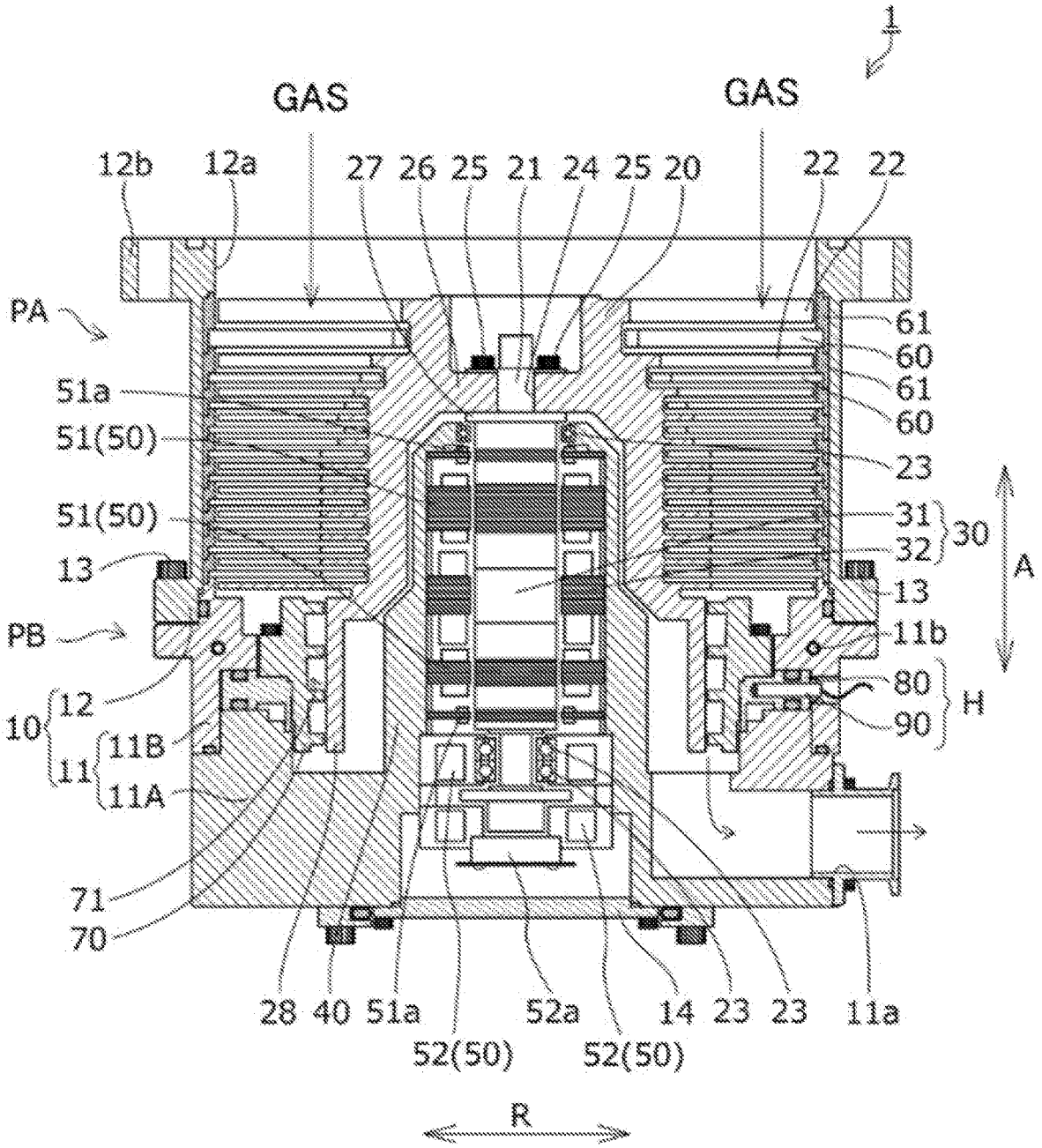
FIG. 1 is a cross-sectional view showing a vacuum pump according to an embodiment of the present invention.

FIG. 1 is a longitudinal sectional view showing the vacuum pump 1. The vacuum pump 1 is a combination pump formed of a turbomolecular pump mechanism PA and a thread groove pump mechanism PB that are stored in a casing 10 having a substantially cylindrical shape.

The vacuum pump 1 has the casing 10, a rotor 20 that has a rotor shaft 21 supported rotatably in the casing 10, a drive motor 30 for rotating the rotor shaft 21, and a stator column 40 for storing a part of the rotor shaft 21 and the drive motor 30.

The casing 10 is formed into a bottomed cylinder. The casing 10 is constituted by a base 11 having a gas outlet port 11*a* on a side of a lower portion thereof, and a cylindrical portion 12 having a gas inlet port 12*a* in an upper portion thereof and mounted and fixed onto the base 11 by a bolt 13. Note that reference numeral 14 shown in FIG. 1 represents a back lid.

The base 11 has a basal portion 11A and a base spacer 11B. The basal portion 11A and the base spacer 11B are fixed to each other by a bolt, not shown. A water jacket pipe 11*b* is embedded in the base spacer 11B. The base spacer 11B is kept at a predetermined temperature (e.g., 80° C.) by passing cooling water through the water jacket pipe 11*b*.

The cylindrical portion 12 is attached to a vacuum container such as a chamber, not shown, with a flange 12*b* therebetween. The gas inlet port 12*a* is connected in a communicable manner to the vacuum container, and the gas outlet port 11*a* is connected in a communicable manner to an auxiliary pump, not shown.

The rotor 20 has the rotor shaft 21 and rotor blades 22 that are fixed to an upper portion of the rotor shaft 21 and arranged concentrically with respect to a shaft center of the rotor shaft 21.

The rotor shaft 21 is supported in a non-contact manner by a magnetic bearing 50. The magnetic bearing 50 has a radial electromagnet 51 and an axial electromagnet 52. The radial electromagnet 51 and the axial electromagnet 52 are connected to a control unit, not shown.

The control unit controls excitation currents of the radial electromagnet 51 and the axial electromagnet 52 based on detection values obtained by a radial direction displacement sensor 51*a* and an axial direction displacement sensor 52*a*, whereby the rotor shaft 21 is supported afloat at a predetermined position.

The upper and lower portions of the rotor shaft 21 are inserted into touchdown bearings 23. In a case where the rotor shaft 21 is uncontrollable, the rotor shaft 21, rotating at high speed, comes into contact with the touchdown bearings 23, preventing damage to the vacuum pump 1.

The rotor blades 22 are attached integrally to the rotor shaft 21 by inserting bolts 25 into a rotor flange 26 and screwing the bolts 25 into a shaft flange 27 while having the upper portion of the rotor shaft 21 inserted into a boss hole 24. Hereinafter, the axial direction of the rotor shaft 21 is referred to as "rotor axial direction A", and the radial direction of the rotor shaft 21 is referred to as "rotor radial direction R".

The drive motor 30 is constituted by a rotator 31 attached to an outer circumference of the rotor shaft 21 and a stationary part 32 surrounding the rotator 31. The stationary part 32 is connected to the abovementioned control unit, not shown, and the rotation of the rotor shaft 21 is controlled by the control unit.

The stator column 40 is placed on the base 11 and has a lower end portion fixed to the base 11 by a bolt, not shown.

The turbomolecular pump mechanism PA that is disposed in roughly the upper half of the vacuum pump 1 is described next.

The turbomolecular pump mechanism PA is constituted by the rotor blades 22 of the rotor 20, and stator blades 60 disposed with gaps between the stator blades 60 and the rotor blades 22. The rotor blades 22 and the stator blades 60 are arranged alternately in multiple stages along the rotor axial direction A. In the present embodiment, eleven stages of the rotor blades 22 and ten stages of the stator blades 60 are arranged.

The rotor blades 22 are formed of blades inclined at a predetermined angle, and are formed integrally on an upper outer circumferential surface of the rotor 20. Moreover, the plurality of rotor blades 22 are installed radially around the axis of the rotor 20.

The stator blades 60 are formed of blades inclined in the opposite direction from the rotor blades 22, and are each sandwiched and positioned, in the rotor axial direction A, by spacers 61 that are installed in a stacked manner on an inner wall surface of the cylindrical portion 12. Moreover, the plurality of stator blades 60 are also installed radially around the axis of the rotor 20.

The gaps between the rotor blades 22 and the stator blades 60 are configured to become gradually narrow from the upper side toward the lower side in the rotor axial direction A. The lengths of the rotor blades 22 and the stator blades 60 are configured to become gradually short from the upper side toward the lower side in the rotor axial direction A.

In the turbomolecular pump mechanism PA described above, gas that is drawn through the gas inlet port 12*a* is transferred from the upper side to the lower side in the rotor axial direction A by means of the rotation of the rotor blades 22.

The thread groove pump mechanism PB that is disposed in roughly the lower half of the vacuum pump 1 is described next.

The thread groove pump mechanism PB has a rotor cylindrical portion 28 provided at a lower portion of the rotor 20 and extending along the rotor axial direction A, and a substantially cylindrical stator 70 that is disposed to surround an outer circumferential surface 28*a* of the rotor cylindrical portion 28.

The stator 70 is placed on the base 11, with a spacer 80 described hereinafter therebetween. The stator 70 includes a thread groove portion 71 engraved in an inner circumferential surface 70*a*.

In the thread groove pump mechanism PB described above, the gas that is transferred downward in the rotor axial direction A from the gas inlet port 12*a* is compressed by the drag effect of high-speed rotation of the rotor cylindrical portion 28 and is then transferred toward the gas outlet port 11*a*. Specifically, after being transferred to a gap between the rotor cylindrical portion 28 and the stator 70, the gas is compressed on the inside of the thread groove portion 71 and transferred to the gas outlet port 11*a*. Generally, because the drag effect in the thread groove pump mechanism PB is affected by the gap (distance) between the rotor cylindrical portion 28 and the stator 70, it is necessary that this gap be set at a predetermined size in order for the thread groove pump mechanism PB to exert sufficient exhaust performance.

Figure 2:
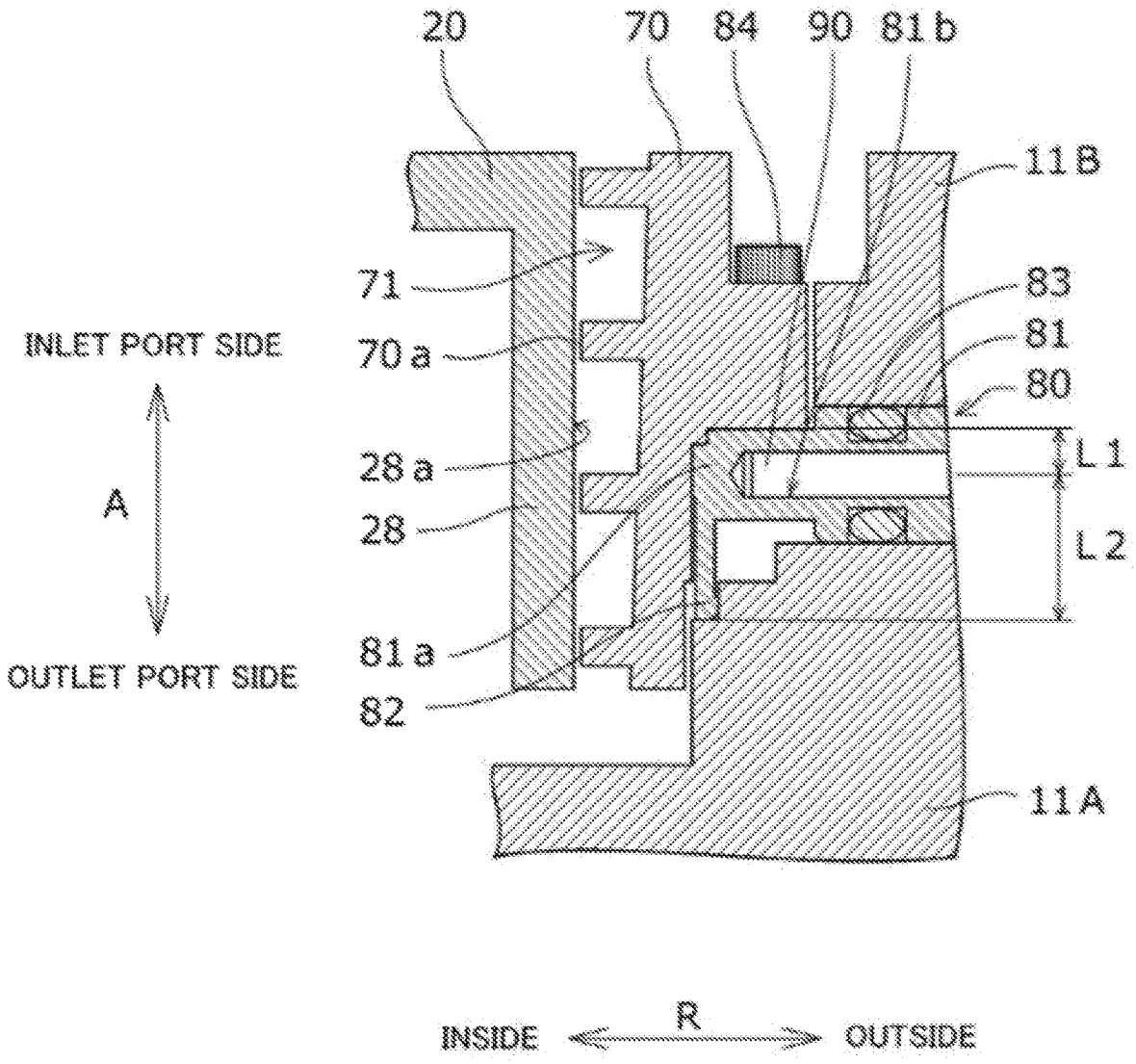
FIG. 2 is an enlarged view showing substantial portions shown in FIG. 1.

A heating structure H for heating the stator 70 is described next with reference to FIGS. 1 and 2. FIG. 2 is an enlarged view showing substantial portions shown in FIG. 1.

The heating structure H has the spacer 80 as a heat insulating means and a cartridge heater 90 as a heating means.

Figure 4:
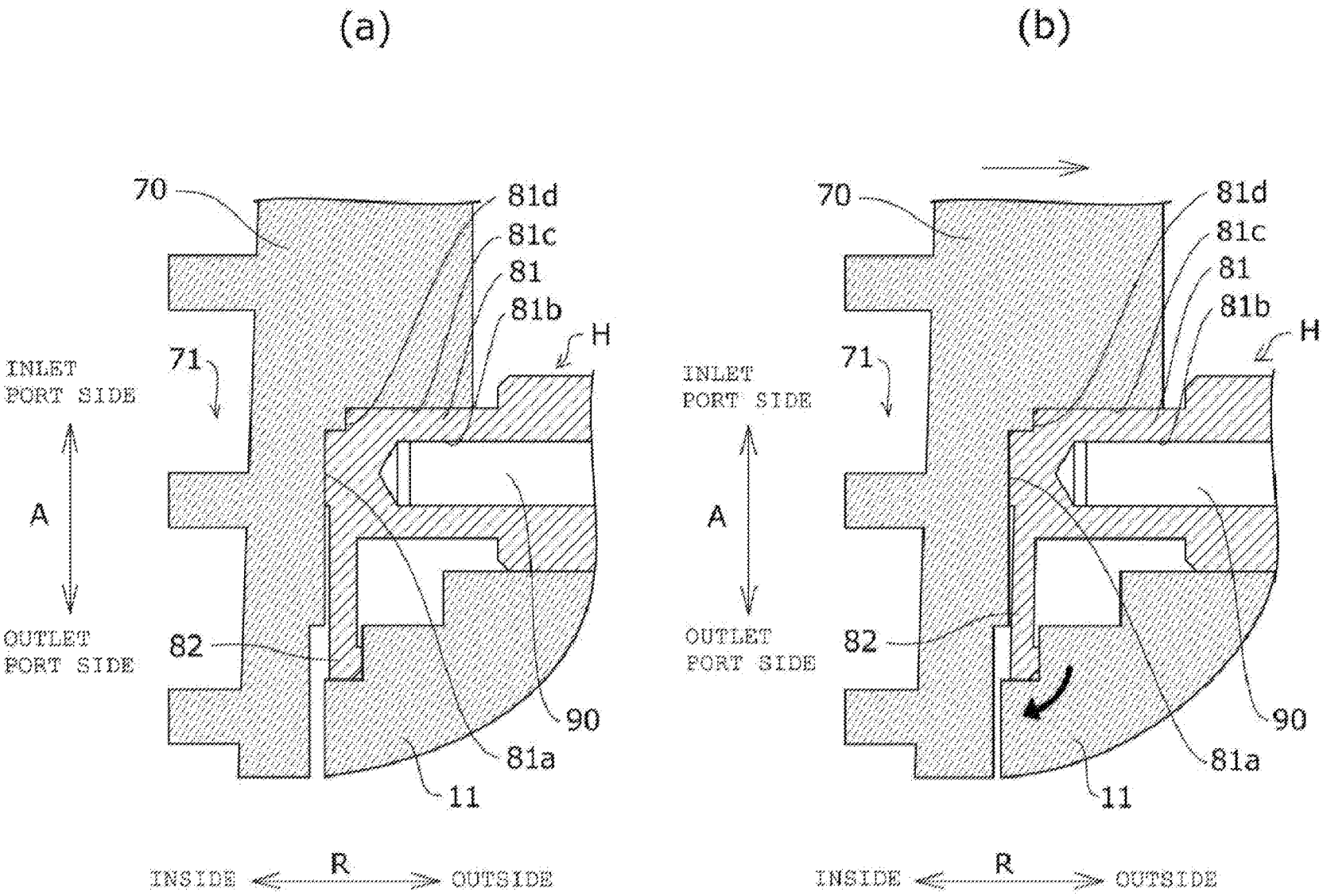

The spacer 80 is formed into a cylinder having a roughly L-shaped cross section. The spacer 80 has a flange portion 81 and a spacer cylindrical portion 82. The spacer 80 is interposed between the base 11 and the stator 70. Specifically, the flange portion 81 supports the stator 70 in the rotor axial direction A. Furthermore, the spacer cylindrical portion 82 is in contact with the base 11 in the rotor axial direction A. It is preferred that the spacer 80 be attached to the base 11 in the rotor radial direction R with a spigot structure such as shown in FIG. 4(*a*) where a portion of the bottom of spacer cylindrical portion 82 extends radially outward to contact base 11 while creating a radial gap between spacer cylindrical portion 82 and base 11 directly above the portion of spacer cylindrical portion 82 that extends outward. It is also preferred that the spacer 80 be attached in a non-contact manner to the stator 70 in the rotor radial direction R at positions other than minimum necessary contact points for determining center positions with a spigot structure such as shown in FIG. 4(*a*) where flange portion 81a extends radially inward to contact stator 70 so as to produce a radial gap between spacer 80 and stator 70 directly below flange portion 81*a*. Accordingly, the heat within the spacer 80 is easily transferred to the stator 70, preventing the heat from being transmitted to stator components other than the stator 70, as will be described hereinafter.

The flange portion 81 has a stator receiving portion 81*a* that slightly protrudes inward in the rotor radial direction R. While the pump is stopped, the stator 70 and the stator receiving portion 81*a* oppose each other, with a slight gap therebetween.

The flange portion 81 is provided in the base 11, with an O-ring 83 therebetween. Therefore, the flange portion 81 is positioned at a predetermined position without coming into direct contact with the base 11. In addition, even in a case where the stator 70 is heated to a predetermined temperature (e.g., 150° C.), the presence of O-ring between the base 11 and the flange portion 81 can prevent the heat of the stator 70 from escaping to the base 11. The flange portion 81 is coupled integrally to the stator 70 by a bolt 84. It is preferred that the bolt 84 and the bolts used in the vacuum pump generally be made of stainless steel in terms of corrosion resistance and structural strength against corrosive gas.

The spacer cylindrical portion 82 is stretched downward in the rotor axial direction A from an inner circumferential rim of the flange portion 81. The spacer cylindrical portion 82 is formed thinner than the flange portion 81 in order to prevent an increase in contact thermal resistance, which is described hereinafter, while ensuring the necessary strength for positioning the stator 70 in the rotor axial direction A. The spacer cylindrical portion 82 is formed to a thickness of, for example, approximately 1 mm to 5 mm.

The cartridge heater 90 is stored in a heater storage 81*b* of the flange portion 81. The cartridge heater 90 is connected to a heater controller, not shown, which controls the temperature of the cartridge heater 90. The cartridge heater 90 is adjusted appropriately so as to keep the temperature of the stator 70 at a predetermined value.

A distance L1 from the cartridge heater 90 to the contact portion between the stator 70 and the flange portion 81 is set to be shorter than a distance L2 from the cartridge heater 90 to the contact portion between the base 11 and the spacer cylindrical portion 82. Therefore, a heat transfer path from the cartridge heater 90 to the stator 70 is shorter than a heat transfer path from the cartridge heater 90 to the base 11, preventing the heat of the spacer 80 from escaping to the base 11. Furthermore, because the area of contact between the base 11 and the spacer cylindrical portion 82 is smaller than the area of contact between the stator 70 and the flange portion 81, the heat of the spacer 80 can be prevented from escaping to the base 11.

Figure 3:
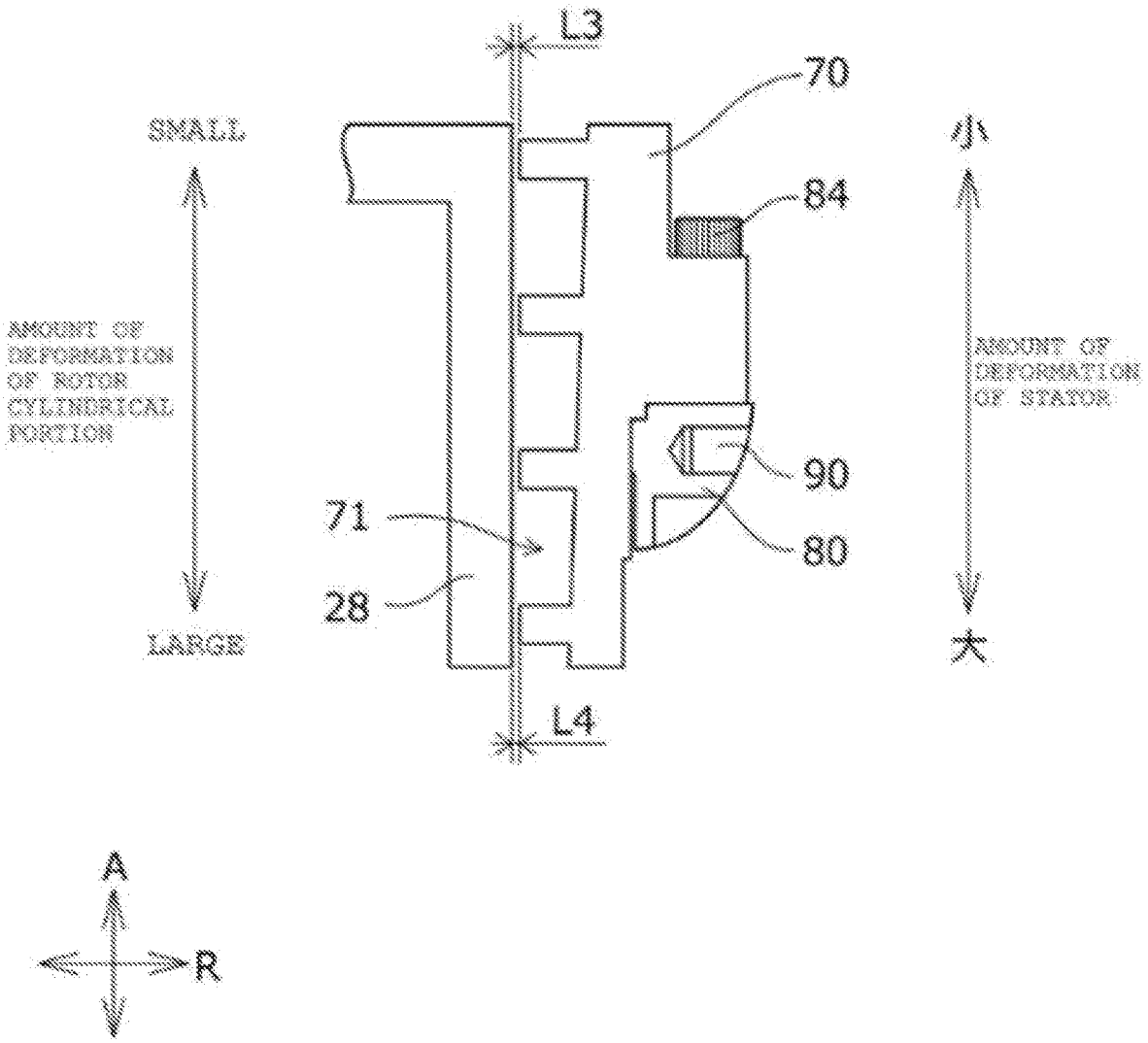
FIG. 3 is a cross-sectional view showing a rotor cylindrical portion and a stator.

The distance between the rotor cylindrical portion 28 and the stator 70 is described next with reference to FIGS. 2 and 3. FIG. 3 is a cross-sectional view showing the rotor cylindrical portion 28 and the stator 70. Hatching is omitted in FIG. 3 for convenience of explanation.

The outer circumferential surface 28*a* of the rotor cylindrical portion 28 and the inner circumferential surface 70*a* of the stator 70 oppose each other. A distance L3 between the rotor cylindrical portion 28 and the stator 70 at the upper side (the inlet port side) is set to be equal to or greater than a distance L4 between the rotor cylindrical portion 28 and the stator 70 at the lower side (the outlet port side).

Specifically, during the operation of the pump, the rotor cylindrical portion 28 becomes deformed outward in the rotor radial direction R due to centrifugal force. Such deformation caused by centrifugal force becomes significant from the upper side of the rotor cylindrical portion 28 toward the lower side due to the structural characteristics. The rotor cylindrical portion 28 also thermally expands outward in the rotor radial direction R substantially evenly from the upper side to the lower side due to radiant heat from the stator 70. Therefore, the amount of deformation of the rotor cylindrical portion 28 considering the centrifugal force and thermal expansion caused during the operation of the pump becomes gradually significant from the upper side toward the lower side. Table 1 shows an example of the amount of deformation of the rotor cylindrical portion 28 that is caused by centrifugal force, and Table 2 shows an example of the amount of deformation of the rotor cylindrical portion 28 that is caused by the thermal expansion thereof when the temperature of a portion to be heated during the operation of the pump is set at 100° C. or 150° C.

TABLE 1

| Portions to be heated | Number of rotations During operation of pump |
|---|---|
| Rotor cylindrical portion, upper side | 0.15 mm to 0.20 mm |
| Rotor cylindrical portion, lower side | 0.20 mm to 0.25 mm |

TABLE 2

| | Change in temperature [ΔT] | |
|---|---|---|
| Portions to be heated | 75 C.° (Temperatures of portions to be heated 100 C.°) | 125 C.° (Temperatures of portions to be heated 150 C.°) |
| Rotor cylindrical portion, upper side | 0.1 mm to 0.2 mm | 0.2 mm to 0.3 mm |
| Rotor cylindrical portion, lower side | 0.1 mm to 0.2 mm | 0.2 mm to 0.3 mm |

As shown in Tables 1 and 2, the total amount of deformation of the rotor cylindrical portion 28 caused by centrifugal force and thermal expansion is approximately 0.35 mm to 0.50 mm at the upper side and is approximately 0.40 mm to 0.55 mm at the lower side, the temperature of the rotor cylindrical portion 28 reaching 150 ° C. during the operation of the pump.

On the other hand, the stator 70 has its upper portion inhibited from being deformed in the rotor radial direction R, by the bolt 84 and the spacer 80 that have lower linear expansion coefficients and higher elastic coefficients than the stator 70 does. For this reason, the amount of deformation of the stator 70 due to thermal expansion is greater at the lower side than the upper side. In other words, due to the differences in elastic coefficient and linear expansion coefficient between the members that are provided inside and outside in the rotor radial direction R, the amount of deformation of the stator 70 due to thermal expansion during the operation of the pump becomes significant from the upper side toward the lower side. When the spacer 80 does not inhibit the deformation of the stator 70, the amount of deformation of the stator 70 due to thermal expansion is substantially even from the upper side to the lower side as with the rotor cylindrical portion 28, but the present invention employs a structure in which the amount of deformation of the stator 70 in the rotor radial direction R is made different between the upper side and the lower side by inhibiting the deformation of the stator 70 at the upper side by means of members that have lower linear expansion coefficients and higher elastic coefficients than the stator 70 does.

As a result, in a case where the rotor cylindrical portion 28 comes into contact with the stator 70 due to an abnormality in the vacuum pump 1, the structure employed by the present invention where the amount of deformation of the stator 70 becomes significant from the upper side toward the lower side (especially, the structure for inhibiting the deformation of a portion to which the kinetic energy is easily transmitted) can prevent deformation of the stator 70 and reduce transmission of the kinetic energy to the outside of the pump.

As described above, in view of the fact that the amount of deformation of the rotor cylindrical portion 28 and the amount of deformation of the stator 70 become significant from the upper side toward the lower side during the operation of the vacuum pump 1, and the fact that the bolt 84 restricts the deformation of the upper portion of the stator 70, the distance L3 between the rotor cylindrical portion 28 and the stator 70 at the inlet port side is set to be equal to or greater than the distance L4 between the rotor cylindrical portion 28 and the stator 70 at the outlet port side.

The actions of the heating structure H are described next with reference to FIGS. 4A and 4B. FIG. 4A shows a state obtained prior to thermal expansion of the stator 70, and FIG. 4B shows a state obtained after thermal expansion of the stator 70.

As shown in FIG. 4A, prior to heating by the cartridge heater 90, the stator 70 is supported mainly by an upper end surface 81*c* and a side surface 81*d* of the flange portion 81. Once the cartridge heater 90 is activated, the heat of the cartridge heater 90 is transmitted to the stator 70 through the spacer 80.

When the temperatures of the stator 70 and the spacer 80 rise, the stator 70, made of aluminum alloy, pushes the stator receiving portion 81*a* or the side surface 81*d* outward in the rotor radial direction R, as shown by the thin arrow in FIG. 4B, since the stator 70 has a linear expansion coefficient greater than that of the spacer 80 which is made of stainless steel.

As the flange portion 81 is pushed outward in the rotor radial direction R, the spacer cylindrical portion 82 moves in response to the thermal expansion of the stator 70 and becomes elastically deformed as shown by the thick arrow in FIG. 4B. In this manner, the stator 70 and the flange portion 81 are prevented from coming into contact with each other excessively. Specifically, even in a case where the stator 70 becomes thermally expanded relatively significantly with respect to the spacer 80, the contact thermal resistance between the stator 70 and the spacer 80 and the contact thermal resistance between the spacer 80 and the base 11 can be prevented from becoming excessively low, preventing the heat of the stator 70 from escaping to the base 11.

In the vacuum pump 1 according to the present embodiment as described above, since the stator 70 is heated while being insulated from the other stator components, malfunctions of, for example, electrical components caused by the heat escaping from the stator 70 and deterioration of the strengths of the rotor blades 22 and stator blades 60 can be prevented. Proper operation of the vacuum pump 1 while preventing the solidification of the gas can be realized.

Moreover, the distance L3 between the rotor cylindrical portion 28 and the stator 70 at the inlet port side is set to be equal to or greater than the distance L4 between the rotor cylindrical portion 28 and the stator 70 at the outlet port side. Therefore, even in the event that the rotor 20 becomes deformed due to centrifugal force during the operation of the vacuum pump 1 or that the rotor 20 becomes thermally expanded due to radiant heat from the stator 70, the distance between the rotor cylindrical portion 28 and the stator 70 can be kept at a predetermined distance or a substantially constant degree of variation from the inlet side all the way to the outlet side, preventing problems such as excessive narrowing of a gas flow channel.

In addition, the present invention can be applied to any vacuum pump that has a thread groove pump mechanism, including a combination pump and a thread groove pump. Furthermore, the heating means is not limited to the cartridge heater 90 and therefore may be anything capable of heating the stator 70.

It should be noted that the present invention can be modified in various ways without departing from the spirit of the present invention, and that needless to say the present invention contains all such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump including: a base; a rotor that has a rotor cylindrical portion stored in the base and is supported rotatably on the base; a stator that has a substantially cylindrical shape and is disposed between the base and the rotor cylindrical portion; and a thread groove portion that is engraved on either an outer circumferential surface of the rotor cylindrical portion or an inner circumferential surface of the stator, the vacuum pump comprising:

a motor for rotating the rotor;

a heat insulating means for insulating the stator from stator components other than the stator; and a heater for heating the stator, wherein a distance between the rotor cylindrical portion and the stator at an inlet port side is set to be equal to or greater than a distance between the rotor cylindrical portion and the stator at an outlet port side, and the heater is arranged in the heat insulating means.

2. The vacuum pump according to claim 1, wherein the heat insulating means includes a flange portion that comes into contact with the stator in a rotor axial direction and is provided in the base, and a spacer cylindrical portion that comes into contact with the base in a rotor axial direction and is provided in an inner circumferential rim of the flange portion, and the heat insulating means is a spacer for storing the heater in the flange portion.

3. The vacuum pump according to claim 2, wherein the spacer inhibits the stator from deforming at least partially in a rotor radial direction when thermally expanded.

4. The vacuum pump according to claim 2, wherein the spacer is a member having a linear expansion coefficient lower than that of the stator.

5. The vacuum pump according to claim 2, wherein a distance from the heater to a contact portion between the stator and the flange portion is shorter than a distance from the heater to a contact portion between the base and the spacer cylindrical portion.

6. The vacuum pump according to claim 2, wherein the spacer cylindrical portion allows positioning in a rotor axial direction and is formed so as to be capable of elastically deforming in a rotor radial direction.

7. The vacuum pump according to claim 2, wherein the spacer is attached to the stator in a rotor radial direction with a spigot structure.

8. The vacuum pump according to claim 2, wherein the spacer is attached to the base in a rotor radial direction with a spigot structure.

* * * * *